US009437976B2

(12) United States Patent
Qi et al.

(10) Patent No.: US 9,437,976 B2
(45) Date of Patent: Sep. 6, 2016

(54) ELECTRICAL CONNECTOR

(71) Applicant: FOXCONN INTERCONNECT TECHNOLOGY LIMITED, Grand Cayman (KY)

(72) Inventors: Feng-Jun Qi, Hefei (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/604,772

(22) Filed: Jan. 26, 2015

(65) Prior Publication Data

US 2015/0214668 A1 Jul. 30, 2015

(30) Foreign Application Priority Data

Jan. 24, 2014 (CN) ..... 2014 1 0032291

(51) Int. Cl.

*H01R 24/00* (2011.01)
*H01R 13/6477* (2011.01)
*H01R 13/6471* (2011.01)
*H01R 24/62* (2011.01)

(52) U.S. Cl.

CPC ..... *H01R 13/6477* (2013.01); *H01R 13/6471* (2013.01); *H01R 24/62* (2013.01)

(58) Field of Classification Search

CPC ..... H01R 13/6477; H01R 13/6471; H01R 24/62
USPC ..... 439/660, 676
See application file for complete search history.

(56) References Cited

U.S. PATENT DOCUMENTS

| | | | | |
|---|---|---|---|---|
| 6,749,444 | B2 | 6/2004 | Murr et al. | |
| 6,802,744 | B2 | 10/2004 | Chiang | |
| 7,695,318 | B1 * | 4/2010 | Wang | H01R 24/60 439/607.01 |
| 7,887,370 | B2 * | 2/2011 | Chen | H01R 13/506 439/607.35 |
| 8,011,968 | B2 * | 9/2011 | Lai | H01R 13/65802 439/660 |
| 8,328,565 | B2 | 12/2012 | Westman et al. | |
| 8,591,261 | B2 * | 11/2013 | Das | H01R 13/6477 439/620.05 |
| 8,974,248 | B2 * | 3/2015 | Lan | H01R 13/405 439/607.01 |
| 2013/0196550 | A1 | 8/2013 | Casher et al. | |
| 2014/0213109 | A1 * | 7/2014 | Wu | H01R 24/62 439/607.01 |

* cited by examiner

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

An electrical connector (100) includes: an insulative housing (10) defining a number of receiving spaces (120); a number of contacts (20) mounted to the insulative housing for transmitting high speed signal, each of the contacts including a mating portion (21), a mounting portion (22) received in one of the receiving spaces, and a connecting portion (23) connecting the mating portion and the mounting portion, a gap formed between each mounting portion and corresponding one of the receiving spaces; and a number of insulative members (52) inserted into the receiving spaces respectively to fill the gaps to adjust the impedance of the contacts.

13 Claims, 5 Drawing Sheets

ELECTRICAL CONNECTOR

BACKGROUND OF THE INVENTION

1. Field of the Invention

The present invention relates to an electrical connector for transmitting high speed signal.

2. Description of Related Arts

U.S. Publication No. 2013/0196550, published on Aug. 1, 2013, to Casher et al. discloses a high speed electrical connector. The high speed electrical connector comprises an insulative housing and a contact module mounted to the insulative housing. The contact module comprises a plurality of contacts and an insulative member molding with the contacts. The contacts comprise a first portion enclosed by the insulative member and a second portion exposed outside of the insulative member. The first portion has a width smaller then a width of the second portion for impedance matching consideration.

U.S. Pat. No. 7,695,318, issued on Apr. 13, 2010, to Wang et al., discloses a USB B-type connector. The connector comprises an insulative housing, a plurality of contacts mounted to the insulative housing, and a spacer mounted to a rear portion of the insulative housing. The contact has a portion received in the insulative housing that is shaped differently than other portions thereof. Such design adjusts the impedance of the connector in order for high speed sign transmission.

An improved electrical connector is desired to offer advantages over the related art.

SUMMARY OF THE INVENTION

An object of the present invention is to provide an electrical connector which adjusts connector impedance without changing the structure of the contacts.

To achieve the above-mentioned object, an electrical connector comprises: an insulative housing defining a plurality of receiving spaces; a plurality of contacts mounted to the insulative housing for transmitting high speed signal, each of the contacts comprising a mating portion, a mounting portion received in one of the receiving spaces, and a connecting portion connecting the mating portion and the mounting portion, a gap formed between each mounting portion and corresponding one of the receiving spaces; and a plurality of insulative members inserted into the receiving spaces respectively to fill the gaps to adjust the impedance of the contacts.

According to the present invention, the electrical connector comprises insulative members to fill the gaps to adjust the impedance of the contacts.

DETAILED DESCRIPTION OF THE PREFERRED EMBODIMENT

Reference will now be made in detail to a preferred embodiment of the present invention.

Figure 1:
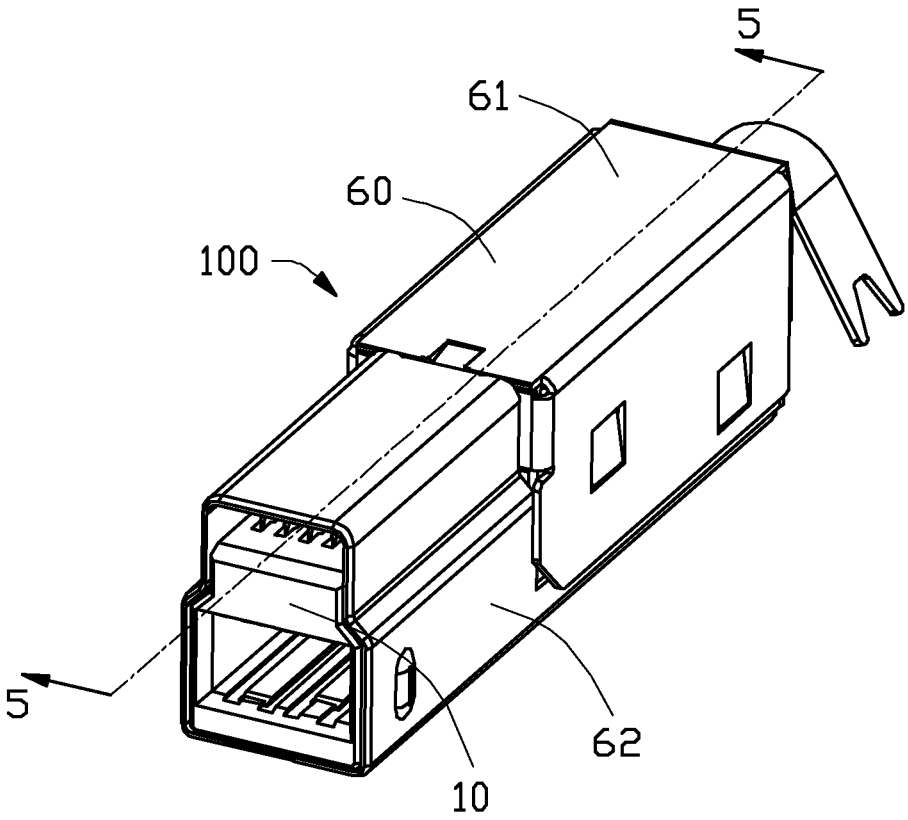
FIG. 1 is a perspective view of an electrical connector in accordance with the present invention.
Figure 2:
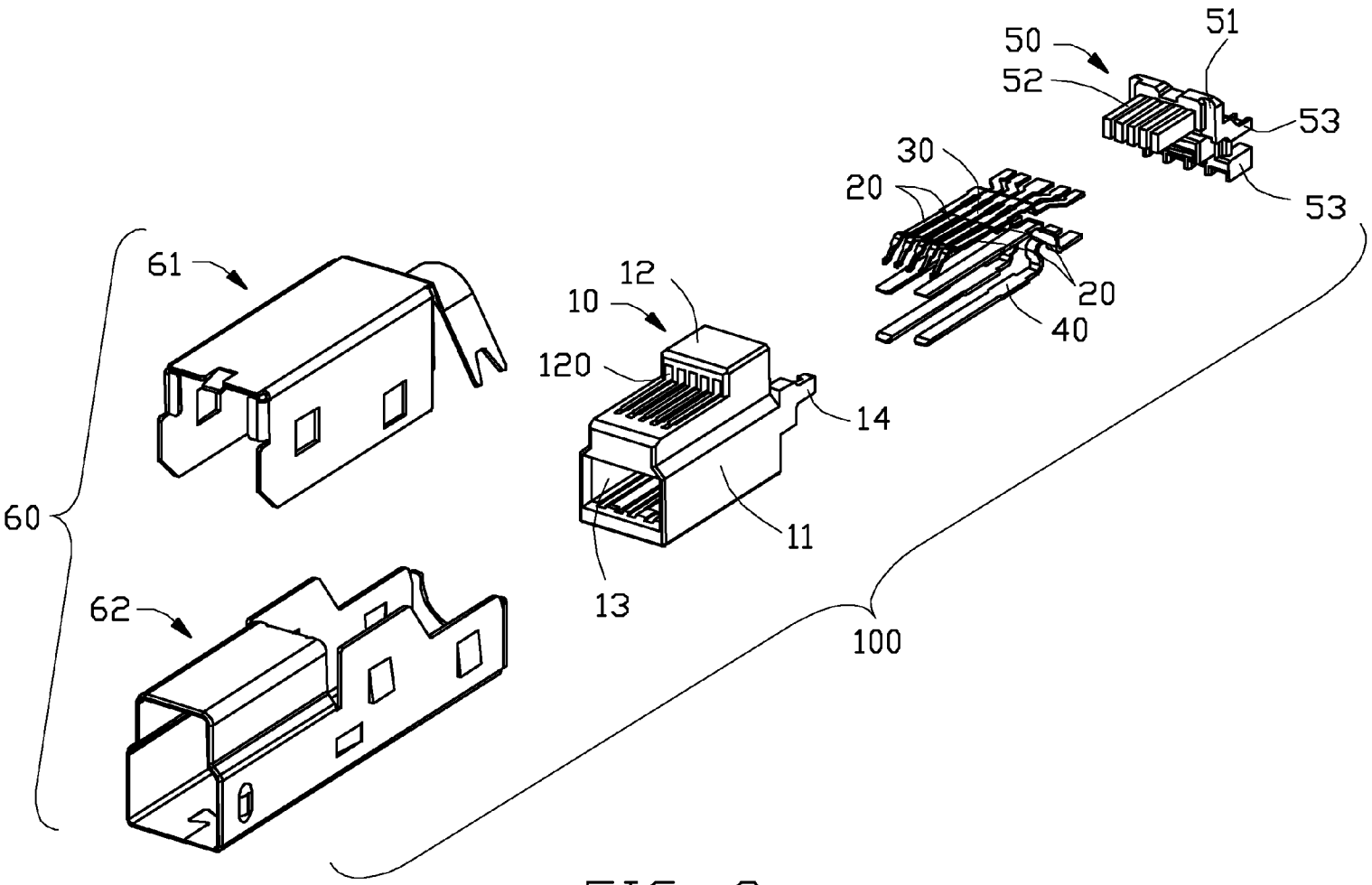
FIG. 2 is an exploded view of the electrical connector as shown in FIG. 1.
Figure 3:
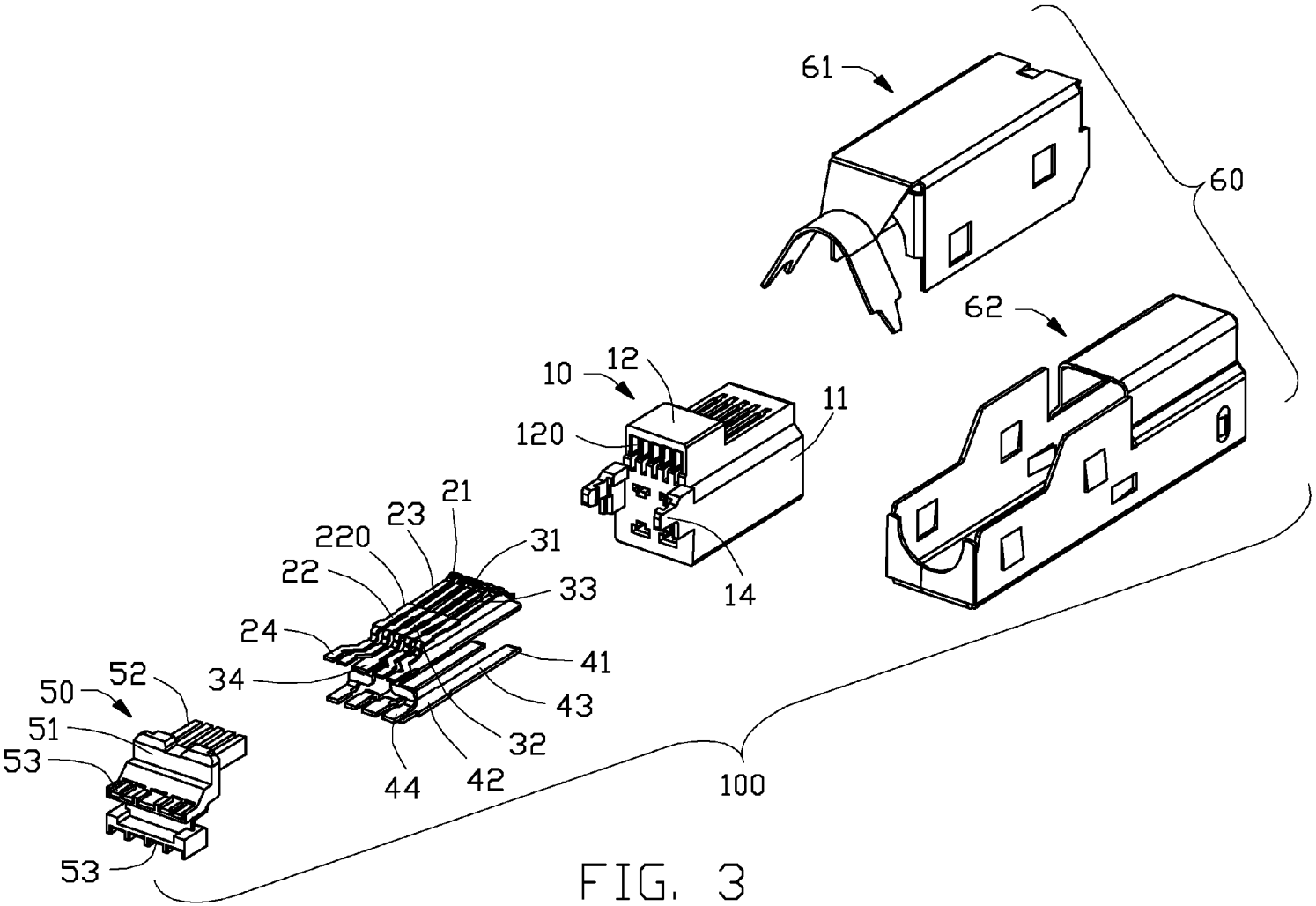
FIG. 3 is another exploded view of the electrical connector as shown in FIG. 2.
Figure 4:
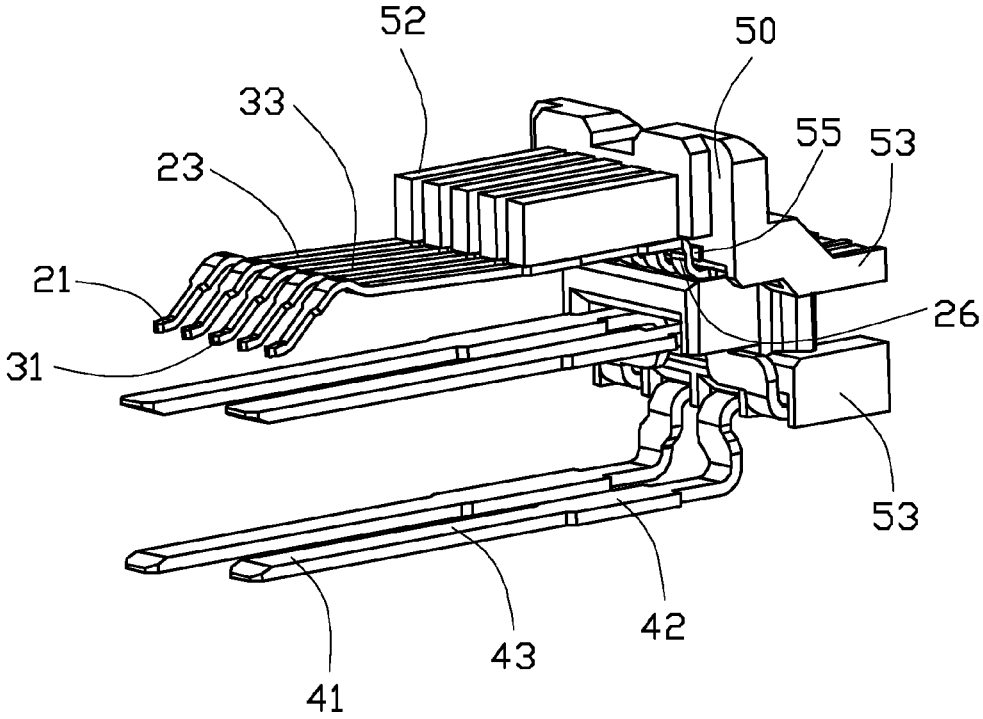
FIG. 4 is a perspective view of the contacts mated with spacer of the electrical connector as shown in FIG. 1.
Figure 5:
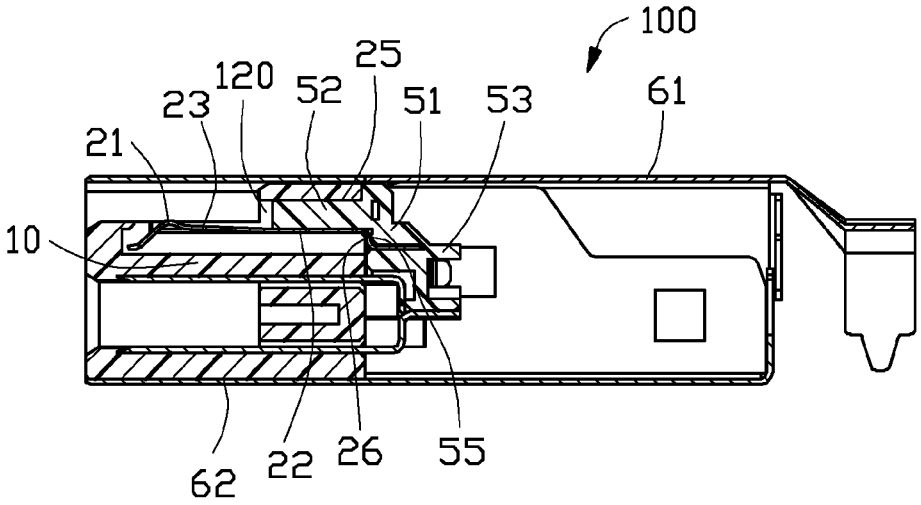
FIG. 5 is a cross-sectional view of the electrical connector taken along line 5-5 of FIG. 1.

Referring to FIGS. 1 to 5, an electrical connector 100 in accordance with the present invention, comprises an insulative housing 10, two pairs of high speed deflectable contacts 20 mounted to the insulative housing 10 and each pair high speed contacts 20 for transmitting a difference signal, a grounding contact 30 disposed between the two pairs of the high speed contacts 20, four low speed immoveable contacts 40 disposed below the high speed contacts 20 and the grounding contact 30, a spacer 50 mounted on rear of the insulative housing 10, and a metal shell 60 covering the insulative housing 10. In this embodiment, the electrical connector 100 is in according with the USB B type standard having a speed up to 10 Gbps. The metal shell 60 comprises a upper shell 61 and a lower shell 62 latched with the upper shell 61.

The insulative housing 10 comprises a main body 11, a protruding platform 12 protruding from a rear portion of the main body 11, a receiving portion or cavity 13 rearwardly recessed from a front portion of the main body 11, and a pair of latching beams 14 spaced apart from each other and rearwardly extending from the main body 11. The protruding platform 12 defines a plurality of receiving spaces 120 for receiving the high speed contacts 20 and the grounding contacts 30. The receiving spaces 120 are arranged side by side and extend through the protruding platform 12 along a front to rear direction. Notably, another receiving cavity (not labeled) formed between the housing 10 and the shell 60, is formed above the high speed contacts 20 and the grounding contact 30.

Each of the high speed contacts 20 comprises a mating/contacting portion 21 disposed at a front portion, a mounting portion 22 received in corresponding one of the receiving spaces 120, a connecting portion 23 connected with the mating portion 21 and the mounting portion 22, and a soldering/tail portion 24 rearwardly extending from the mounting/retaining portion 22. Each of the mounting portion 22 comprises a plurality of tabs 220 extending along a transverse direction and having a width larger than a width of the connecting portion 23. The contacting portion portions extend forwardly beyond the protruding platform 12, when the high speed contacts 20 are received in the receiving spaces 120. The tabs 220 are interference fitted with the receiving spaces respectively to fix the high speed contacts 20 in the receiving spaces 120. A gap 25 is formed between each of the mounting portions 22 and corresponding one of the receiving spaces 120. In a different viewpoint, the receiving space 120 and the corresponding gap 25 may be commonly regarded as a passageway which not only receives the corresponding contact 20 and but also allows insertion of the corresponding contacts thereinto from a rear side of the housing. he grounding contact 30 comprises a grounding mating portion 31 disposed at a front portion, a grounding mounting portion 32 received in corresponding one of the receiving spaces 120, a grounding connecting portion 33 connected with the grounding mating portion 31 and the grounding mounting portion 32, and a grounding soldering portion 34 rearwardly extending from the grounding mounting portion 32. The grounding soldering portion 34 and the soldering portions 24 of the high speed contacts 20 are arranged in a row.

The lower speed contacts 40 is used for transmitting signal in according with the USB 2.0 type B standard. Each of the low speed contacts 40 comprises a mating portion 41 disposed at a front portion, a mounting portion 42 received in the insulative housing 10, a connecting portion 43 connected with the mating portion 41 and the mounting portion 42, and a soldering portion 44 rearwardly extending from the mounting portion 42. The four low speed contacts 40 are divided into two pairs. mating portions 41 of the two pairs of the low speed contacts 40 are spaced apart from each other along a vertical direction. All of the soldering portions 44 of the four low speed contacts are arranged in a row and disposed below the soldering portions 24 of the high speed contacts and grounding soldering portion 34.

The spacer 50 is mounted on a rear portion of the insulative housing 10. The pair of beams 14 are latched with the spacer 50. The latch comprises a base portion 51, a plurality of insulative or inserting members 52 forwardly extending from the base portion 51, and a pair of supporting portions 53, with corresponding partitions thereon, extending rearwardly from the base portion 51 and spaced apart from each other along vertical direction. The soldering portions 24 of the high speed contacts 20 and the grounding soldering portion 34 extend through the spacer 50 and are disposed on the upper supporting portion 53. The soldering portions 44 of the low speed contacts 40 extend through the spacer 50 and are disposed on the lower supporting portion 53. The insulative members 52 are inserted into the receiving spaces 120, respectively, to fill the gaps 25 to adjust the impedance of the high speed contacts 20. The impedance of the high speed contacts 20 is 80-100 Ohm, when the raising time is equal to 40 picoseconds. Therefore, the speed of each pair of the high speed contacts 20 could reach 10 Gbps. The insulative members 52 also can be designed discrete with the spacer and independently inserted into the gaps to adjust the impedance of the high speed contacts 20. The insulative members 52 also can prevent the plastic flowed to the front portion, i.e., the molding contamination, to harm the electrical performance of the mating portions 21 during the high pressure over-molding process. Notably, the contact 20 further includes a vertically offset section 26 between the rear soldering portion 24 and the mounting portion 22, and the spacer 50 forms a step 55 to abut against said offset section 26 for preventing backward movement of the contacts 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing forming opposite first and second receiving cavities in a vertical direction, each of said first and second receiving cavities forwardly communicating with an exterior in a front-to-back direction perpendicular to said vertical direction;

a plurality of first passageways formed in the housing and extending along the front-to-back direction;

a plurality of first deflectable curved contacts disposed in the first passageways, respectively, and extending into the first receiving cavity, each of said first contacts including a front contacting section, a rear tail section and a middle retaining section therebetween in the front-to-back direction;

a plurality of second passageways formed in the housing and extending along the front-to-back direction;

a plurality of second immoveable contacts disposed in the housing and extending around the second receiving cavity, each of said second contacts including a front contacting section, a rear tail section and a middle retaining section therebetween in the front-to-back direction; and an insulative spacer attached behind the housing to regulate the tail sections of both said first contacts and said second contacts in a transverse direction perpendicular to both said vertical direction and said front-to-back direction; wherein each of said first passageways is dimensioned much larger than the corresponding first contact in the vertical direction for allowing forward insertion of the said first contact thereinto from a rear side of the housing, and said spacer includes a plurality of insulative members inserted into rear portions of the corresponding first passageways, respectively, for adjusting impedance of the corresponding first contacts, while the second passageways is dimensioned to be similar to the corresponding second contact in the vertical direction without any insulative members inserted therein; wherein the middle retaining section is located around a middle level of the corresponding first passageway in the vertical direction.

2. The electrical connector as claimed in claim 1, wherein the spacer forms two opposite outward faces in the vertical direction, on which the tail sections of the first contacts and those of the second contacts are seated for soldering to corresponding wires of a cable.

3. The electrical connector as claimed in claim 2, wherein the second contacts are arranged in two opposite rows in the vertical direction.

4. The electrical connector as claimed in claim 1, wherein said spacer is forwardly assembled to the housing in the front-to-back direction, and the housing forms a pair of latching beams to prevent rearward movement of the spacer after assembled.

5. The electrical connector as claimed in claim 1, wherein each of said first contacts includes an vertically offset section between the rear tail section and the middle retaining section in the front-to-back direction, and the spacer forms a step to forwardly confront the offset section for preventing backward movement of the contact.

6. The electrical connector as claimed in claim 5, wherein a pitch of the rear tail sections is larger than that of the front contacting sections.

7. The electrical connector as claimed in claim 1, wherein each of said first contacts has a free end at the front contacting section, and said free end is located below the corresponding middle retaining section in the vertical direction.

8. An electrical connector comprising:

an insulative housing forming a plurality of passageways extending along a front-to-back direction;

a plurality of deflectable contacts assembled into the corresponding passageways, respectively, each of the contacts including a front contacting section, a rear tail section, and a middle retaining section therebetween along the front-to-back direction; and an insulative spacer forwardly attached to a rear side of the housing and including a plurality of inserting members forwardly inserted into the corresponding passageways and abutting against the retaining sections of the corresponding contacts in a vertical direction perpendicular to said front-to-back direction, respectively, and a plurality of partitions on a supporting portion thereof to regulate the tail sections of the contacts, respectively; wherein the middle retaining section is located around a middle level of the corresponding first passageway in the vertical direction.

9. The electrical connector as claimed in claim 8, wherein a pitch of the tail sections is larger than that of the contacting sections.

10. The electrical connector as claimed in claim 9, wherein each of said contacts further includes a vertically offset section located between the retaining section and the tail section in the front-to-back direction, and extending at least along a vertical direction perpendicular to said front-to-back direction, and said spacer includes a step to forwardly confront the vertically offset sections of the contacts to prevent backward movement of the corresponding contacts.

11. The electrical connector as claimed in claim 8, wherein the inserting members downwardly confront the retaining portions of the corresponding contacts while the supporting portion upward confronts the tail sections of the corresponding contacts.

12. The electrical connector as claimed in claim 8, wherein said housing further includes a plurality of second passageways extending along the front-to-back direction with corresponding second immoveable contacts therein, and said spacer further includes another supporting portions to regulate tail sections of the corresponding second contacts while without any inserting members inserted into the corresponding second passageways, respectively, said supporting portion and said another supporting portion being opposite to and facing away from each other in the vertical direction.

13. The electrical connector as claimed in claim 8, wherein each of said contacts has a free end at the front contacting section, and said free end is located below the corresponding middle retaining section in the vertical direction.

* * * * *